United States Patent [19]

Friend

[11] 4,096,041

[45] * Jun. 20, 1978

[54] SINGLE-SPOT QUENCH CAR

[75] Inventor: Donald L. Friend, Allison Park, Pa.

[73] Assignee: United States Steel Corporation, Pittsburgh, Pa.

[ * ] Notice: The portion of the term of this patent subsequent to Aug. 2, 1994, has been disclaimed.

[21] Appl. No.: 776,402

[22] Filed: Mar. 10, 1977

Related U.S. Application Data

[63] Continuation-in-part of Ser. No. 664,774, Mar. 8, 1976, Pat. No. 4,039,394.

[51] Int. Cl.[2] ..... C10B 39/08; C10B 39/14; C10B 45/00

[52] U.S. Cl. ..... 202/263; 202/227; 202/253; 202/262; 214/18 PH

[58] Field of Search ..... 202/263, 262, 253, 227; 214/18 R, 18 PH; 13/33

[56] References Cited

U.S. PATENT DOCUMENTS

| | | | |
|---|---|---|---|
| 1,831,720 | 11/1931 | Riecke | 202/252 |
| 2,580,700 | 1/1952 | Phillips | 202/252 |
| 3,806,032 | 4/1974 | Pries | 202/263 |
| 3,868,309 | 2/1975 | Sustarsic et al. | 202/262 |
| 3,951,751 | 4/1976 | Jakimowicz et al. | 202/253 |
| 3,970,526 | 7/1976 | Bender | 202/253 |
| 3,984,289 | 10/1976 | Sustarsic et al. | 202/262 |
| 4,039,394 | 8/1977 | Friend | 202/227 |

*Primary Examiner*—Morris O. Wolk
*Assistant Examiner*—Bradley Garris
*Attorney, Agent, or Firm*—Frank Madonia

[57] ABSTRACT

An arrangement adapting a slatted top to a single-spot quench car. The slats are opened and closed in selected groups.

8 Claims, 6 Drawing Figures

SINGLE-SPOT QUENCH CAR

This application is a continuation-in-part of a U.S. patent application, Ser. No. 664,774, filed Mar. 8, 1976, now U.S. Pat. No. 4,039,394, and having common ownership.

BACKGROUND

The parent application discloses a slatted top closure for a quench car. It had been common practice in coke-making to transport incandescent coke from a coke oven to a quench tower in an open top quench car. This practice is subject to criticism because between the pushed oven and the quench tower, the combustion of coke in the car causes considerable pollution of the air. The slatted top quench car maintains the car in a covered state except when access to the car is required as when coke enters and when coke is quenched. The slatted top quench car has a plurality of normally closed slats transversing the top of the quench car. These slats are adapted to be opened to admit coke and quenching water into the car.

SUMMARY

Though the prior invention is not limited to the use of a slatted top on a traveling-type quench car, an object of the present invention is to present an arrangement adapting the slatted top principle to a single-spot quench car.

Quench cars in general are of two basic types: the traveling type and the single-spot type. The traveling quench car receives a push of coke from a coke oven as the car passes the oven. The single-spot quench car, on the other hand, remains stationary in front of the oven to receive the coke as it is pushed from the oven. For this reason, the single-spot quench car is deeper than, but not as long as the traveling quench car. In the case of both cars, the coke received in the car is transported to a quench tower, quenched in the car, then dumped from the car.

According to the present invention, there is provided a single-spot coke quench car for receiving incandescent coke from a coke oven and transporting it to a quenching site for quenching, the quench car having a top closure which comprises a plurality of slats transversing the top of the quench car and means for opening the slats in pre-selected groups to permit access to the interior of the car from above.

This invention also can be used in conjunction with a canopy or shroud at the coke oven or with a companion scrubber car or with both.

The invention will be further described by way of example with reference to the accompanying drawings, in which.

Figure 1:
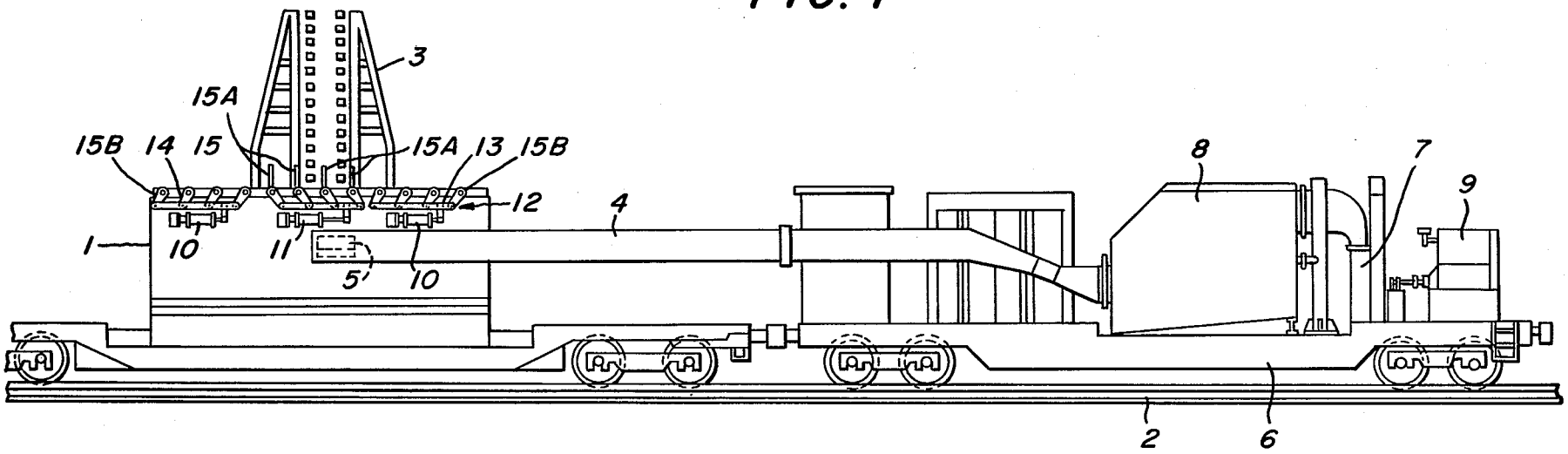
FIG. 1 is a side elevation view of a quench car constructed in accordance with the invention in position under a coke guide in front of a coke oven and followed by a gas evacuation and scrubber car.

Referring now to FIG. 1, quench car 1 is shown in position on rails 2 passing in front of coke guide 3. The function of the coke guide 3, as is known in the art, is to guide the hot, incandescent coke in its path from the coke oven from which it is pushed into the quench car. Along the side of quench car 1 may be placed a duct 4 having occasional access through openings 5 to the interior of the quench car 1. The duct 4 is connected to an integral gas evacuation and scrubbing car 6 which carries a suction fan 7 and a gas scrubbing vessel 8 which contains means (not shown) for spraying the gas and air in a conventional manner to remove contaminants. A pump 9 is placed on scrubbing car 6 to circulate the required water or other liquid through the scrubbing vessel 8.

Figure 5:
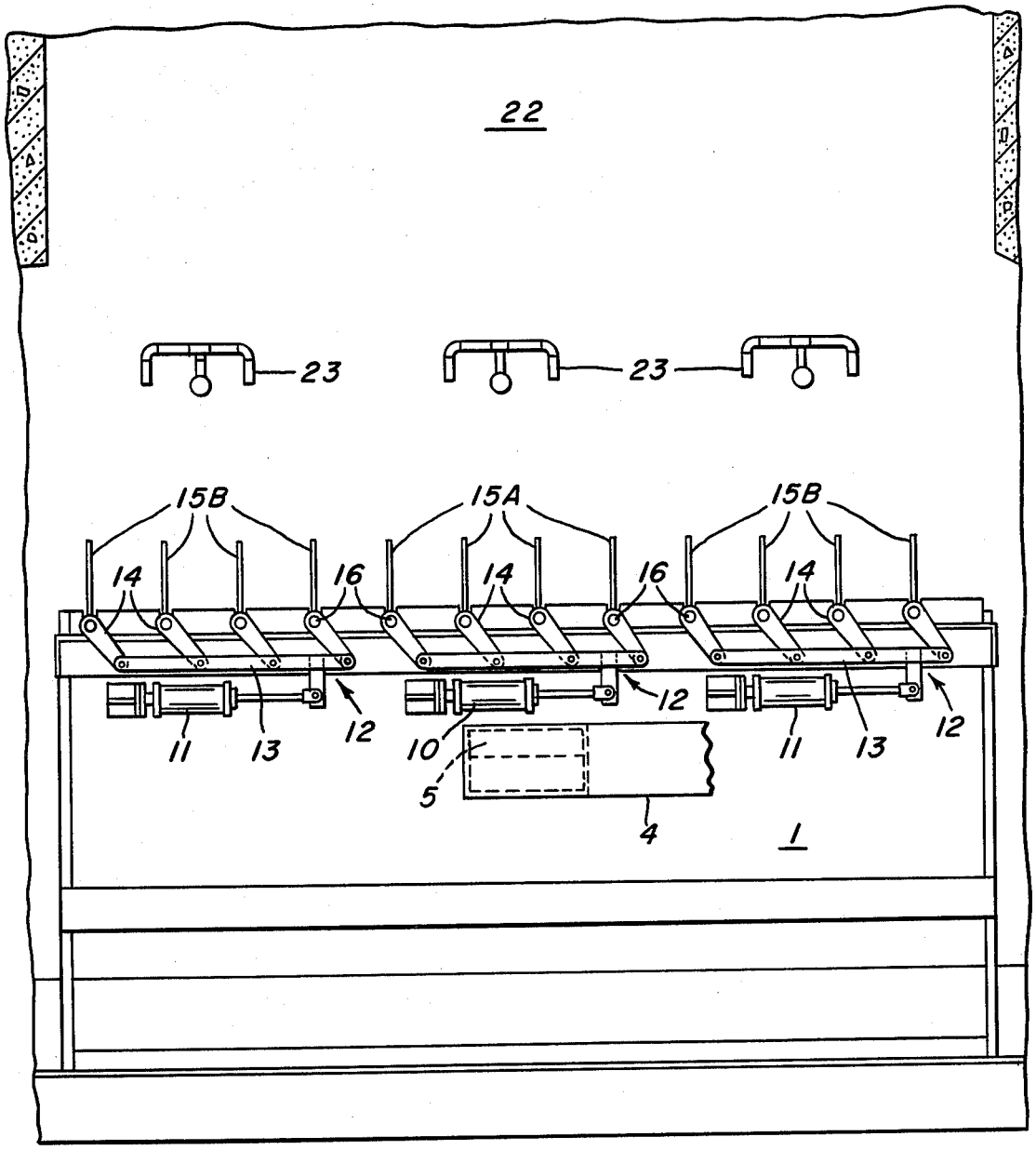
FIG. 5 is a side view showing the position of the slats when the quench car is in a quench tower.
Figure 6:
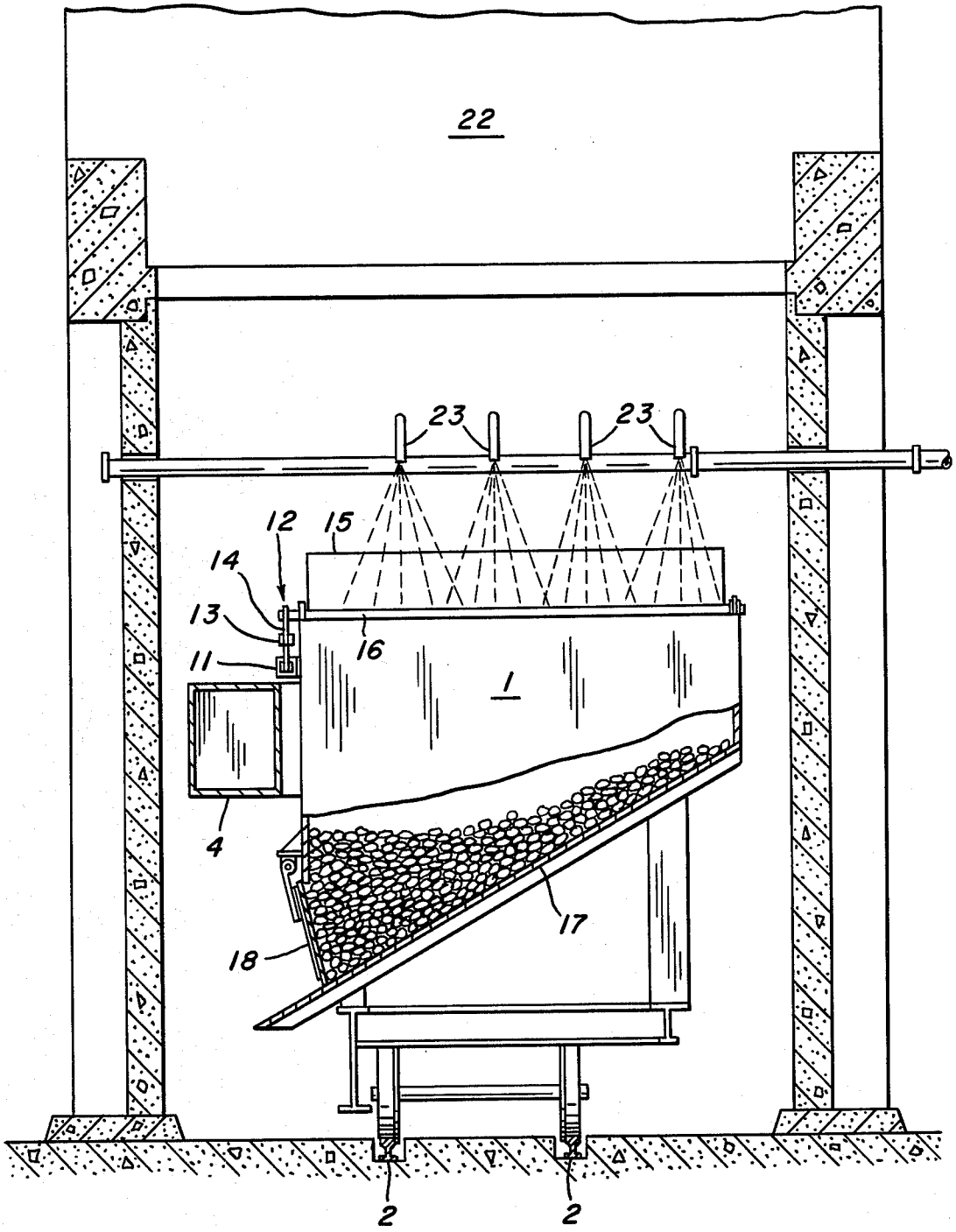
FIG. 6 is a partially sectioned end view of the quench car in the quench tower.

Cylinders 10 and 11 are mounted on the near side of quench car 1. Linkages 12 comprising connecting arms 13 and lever arms 14 connect cylinders 10 and 11 to slats 15. In the preferred embodiment, the slats are linked together to form three separate groups. The slats in any group open and close together in response to movement of the air cylinder connected to that group. The center group of slats 15A is depicted in FIGS. 1–4 in the open position. In those same figures, the two end groups 15B are depicted in the closed position. In FIGS. 5 and 6 all three groups are in the open position. Slats 15 are attached along one edge to bars 16 and preferably overlap with the free edge resting on the adjacent bar as shown. The slats may also abut, but overlapping is preferred. In any event, slats 15 are sufficient in width and number to cooperate to form a top closure for quench car 1. Slats 15 may also be counterweighted as in the prior invention, but this is not necessary as the cylinders alone may be capable of moving the slats. Cylinders 10 and 11 may be hydraulic or air operated. Air operation is preferred, as the cushion effect associated with air cylinders helps eliminate impact between the slats and bars.

Figure 2:
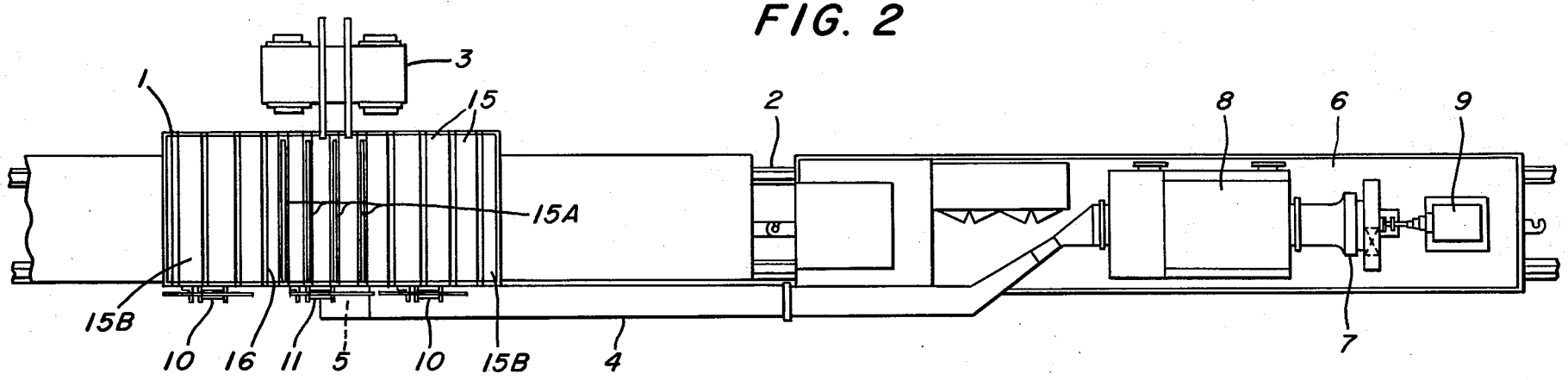
FIG. 2 is a top plan view of the quench car and gas scrubbing car showing a group of slats of the quench car open in front of the coke guide.

Referring now to FIG. 2, the overhead view shows quench car 1 and scrubbing car 6 on rails 2, with quench car 1 passing by the coke guide 3. The slats 15A in front of coke guide 3 are in the open (vertical) position; all other slats 15B are in the closed (horizontal) position to retain the fumes and products of combustion within the quench car 1.

Figure 3:
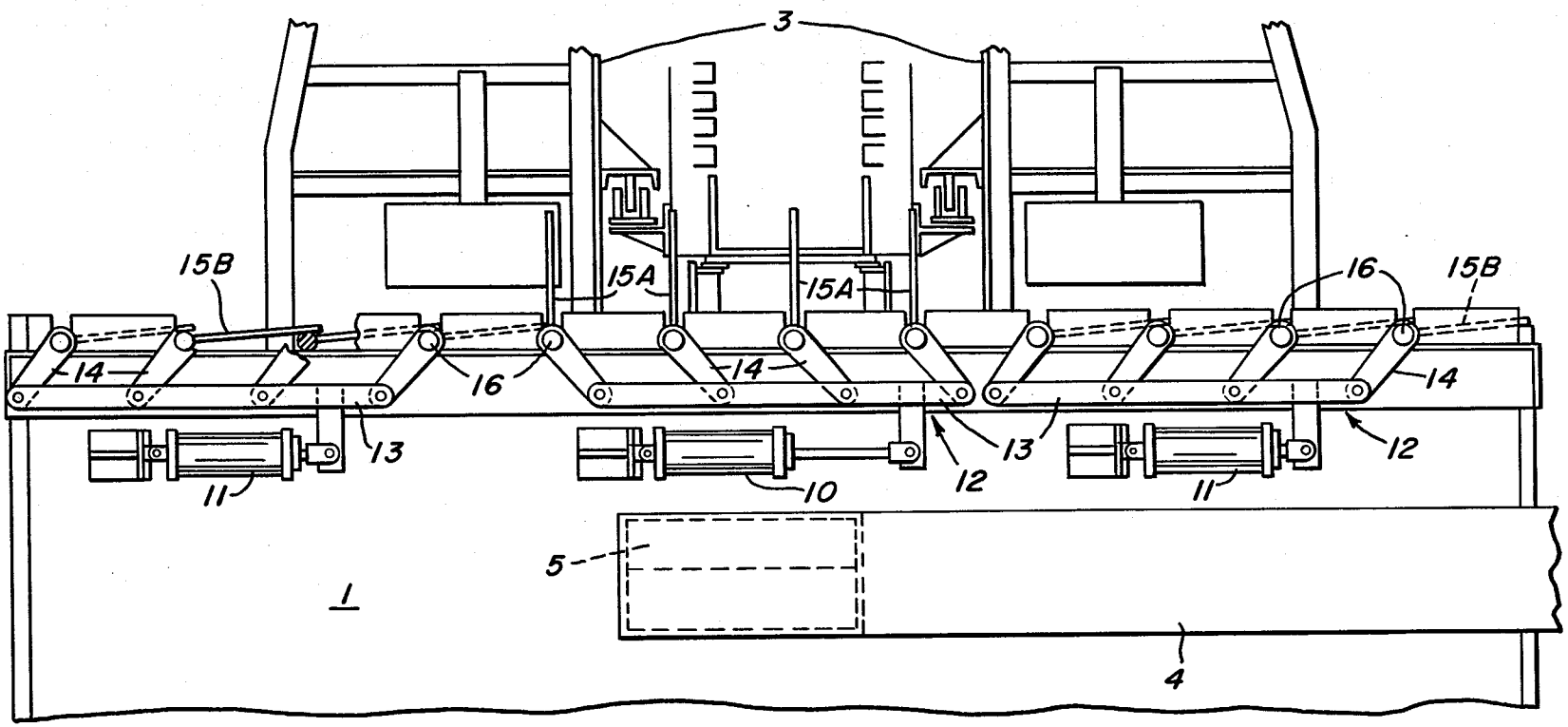
FIG. 3 is a detailed side view showing operation of the cylinder and linkage to open a group of slats to receive the coke.

In FIG. 3, the group of slats 15A is seen in its open position as the quench car 1 is positioned at the coke guide 3. Incandescent coke passes through the opening or slot in the coke guide directly downward between open or vertical slats 15A and into the interior of quench car 1. Positioned on the quench car is the actuating means in the form of air cylinder 10 for opening the slats 15A. The other groups of slats 15B remain closed when coke is received in the car. In the depicted configuration, all slats 15 are rotatable on or with bars 16, which transverse the top of the quench car 1. Lever arms 14 are moved about 80° to 90° so that the slats 15 move into a vertical position as at 15A, thus permitting the incandescent coke in the opening in the coke guide to fall between slats 15A and into the quench car 1. Since, in the preferred configuration, the slats 15 contact the adjacent bars 16 when in the closed position and thus are about 5° off the horizontal, the slats 15 need to rotate only about 85°.

Figure 4:
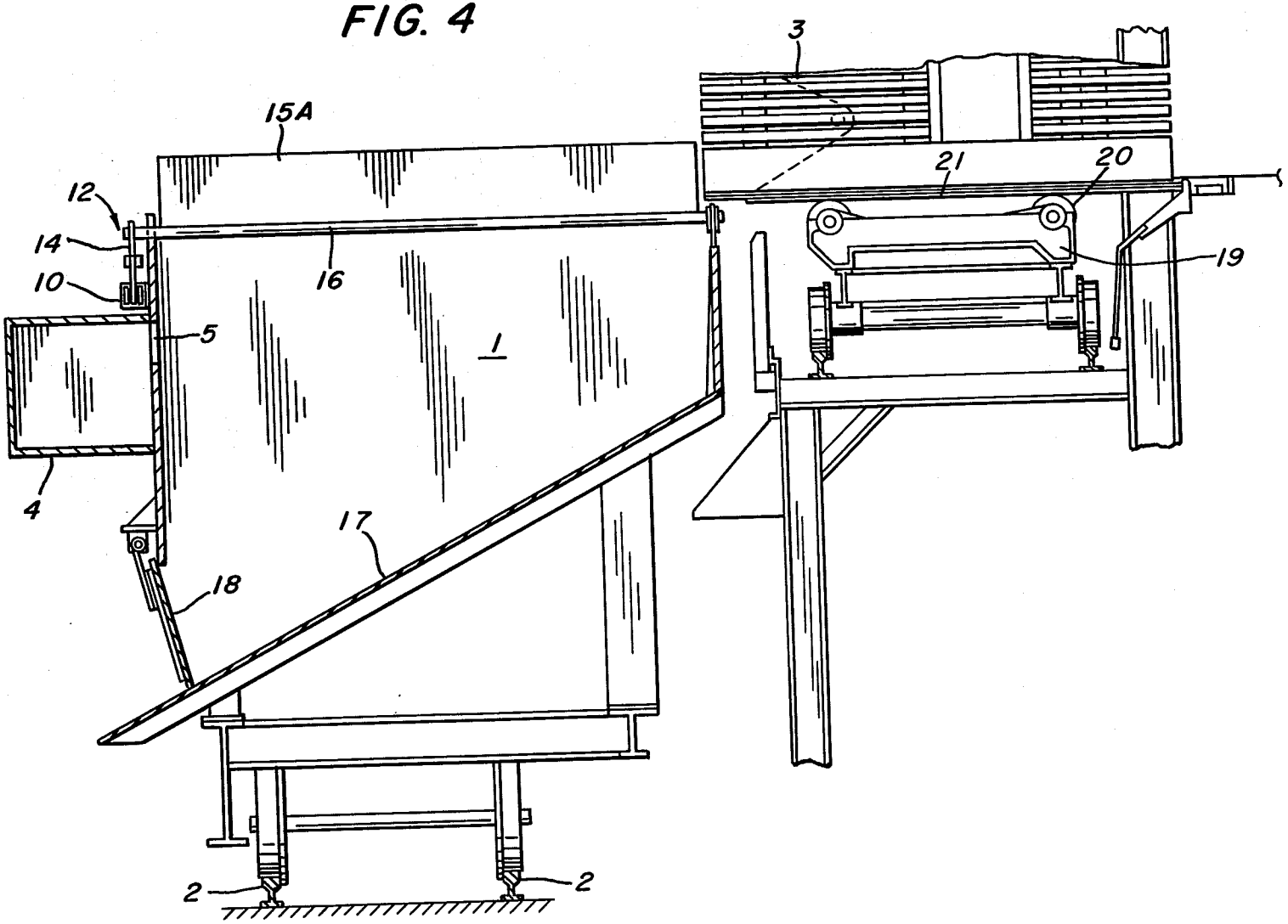
FIG. 4 depicts the quench car from one end and shows the relative positions of a slat, its linkage and cylinder, and a coke guide car.

In FIG. 4, quench car 1 is seen from an end view showing the typically sloping floor 17, and dumping element 18, which may be opened in a conventional manner to release the quenched coke. Also seen from a different perspective are rails 2, duct 4, slat 15A, bar 16, and coke guide 3. Coke guide 3 is typically mounted on a coke guide car 19 and may be positioned relative to the coke oven door (not shown) by wheels 20 and ways 21.

In FIG. 5, all three groups of slats 15A and 15B are shown in their opened position in a quench tower 22. Cylinder 10 opens the center group 15A, cylinders 11 open the end groups 15B. The slats are held open during the quench operation as in the coke pushing step, except that in the quench tower all three groups may be open while quench water emanates from nozzles or pipes 23. As soon as quench car 1 is removed from the quench tower, all the slats are moved to their normally closed position. The end view in FIG. 6 of the quenching operation again shows quenching tower 22, quench pipes 23, bars 16, and duct 4.

Through the above described arrangement of the slats in groups with one group of slats opened at once to receive coke and all groups opened together to quench the coke, the principle of the slatted top is adapted to the single-spot quench car. With this arrangement, the opening in the top of the single-spot quench car may be partially opened for receiving coke and completely opened for quenching coke in the car.

The illustrated embodiment may be varied in several respects, as for example the cylinders may be actuated by automatic controls such as electrical or penumatic signals or actuators. However, because of the severe conditions created by the handling of incandescent coke, mechanical controls are preferred. The number of slats may vary, but will be limited by the desirability of avoiding striking the coke guide or parts of the quench car when opening or closing. The preferred number of three groups of slats may also be varied.

Other aspects may be varied and still fall within the scope of the invention as defined in the following claims.

I claim:

1. A coke quench car for receiving incandescent coke from a coke oven and transporting it to a quenching site for quenching, said car being of the type having dimensions which enable it to be filled with incandescent coke while said car remains in a fixed position relative to said coke oven, said car comprising:

(a) an open top container for said coke;

(b) a plurality of slats having substantially parallel edges transversing the top of said container, said slats having sufficient width to permit the opposing edges thereof to cooperate to form a closure which prevents the emission of fumes into the atmosphere above said car; and (c) means for opening at least some of said slats to permit coke to pass into said quench car from above and to close said slats after coke is received in said car, said means comprising:

(1) lever means attached to one end of each slat, (2) linkage means attached to said lever means and joining preselected groups of said slats, and (3) means attached to said linkage means for moving said lever means to selectively open said groups of slats.

2. The apparatus defined in claim 1 wherein said slats are joined so as to form three separate groups.

3. The apparatus defined in claim 1 wherein said means for moving said lever means comprises air cylinders.

4. The apparatus defined in claim 1 wherein said means attached to said linkage means comprises motor means mounted on said car.

5. In a coke quenching system which includes a quench car for receiving incandescent coke from a coke oven and transporting it to a quenching site for quenching, said car of the type having dimensions sufficient to receive said coke while in a fixed position relative to said coke oven; an improvement in said car, comprising:

(a) a plurality of slats having substantially parallel edges transversing the top of said car, said slats having sufficient width to permit the opposing edges thereof to cooperate to form a closure which prevents the emission of fumes into the atmosphere above said car; and (b) means for opening at least some of said slats to permit coke to pass into said car from above, for closing said slats after coke is received in said car, and for opening said slats to permit quenching of said coke, said means comprising:

(1) lever means attached at one end of each slat, (2) linkage means attached to said lever means and joining preselected groups of said slats, and (3) means attached to said linkage means for moving said lever means to selectively open said groups of slats.

6. The improvement defined in claim 5 wherein said slats are joined so as to form three separate groups.

7. The improvement defined in claim 5 wherein said means for moving said lever means comprises air cylinders.

8. The improvement defined in claim 5 wherein said means attached to said linkage means comprises motor means mounted on said car.

* * * * *